US007171820B2

(12) United States Patent
Eisenhower

(10) Patent No.: US 7,171,820 B2
(45) Date of Patent: Feb. 6, 2007

(54) NON-LINEAR CONTROL ALGORITHM IN VAPOR COMPRESSION SYSTEMS

(75) Inventor: Bryan A. Eisenhower, East Hartford, CT (US)

(73) Assignee: Carrier Corporation, Syracuse, NY (US)

( * ) Notice: Subject to any disclaimer, the term of this patent is extended or adjusted under 35 U.S.C. 154(b) by 414 days.

(21) Appl. No.: 10/793,486

(22) Filed: Mar. 4, 2004

(65) Prior Publication Data

US 2005/0193746 A1 Sep. 8, 2005

(51) Int. Cl.

| | |
|---|---|
| ***F25D 17/00*** | (2006.01) |
| ***F25B 41/00*** | (2006.01) |
| ***G05D 15/00*** | (2006.01) |
| ***G05B 13/02*** | (2006.01) |

(52) U.S. Cl. ..... 62/180; 62/209; 236/78 D; 700/42

(58) Field of Classification Search ..... 62/238.6, 62/238.7, 228.3, 185, 180, 181, 183, 184; 236/78 D; 700/28, 31, 40, 42, 43; 237/2 A, 237/2 B, 8 A See application file for complete search history.

(56) References Cited

U.S. PATENT DOCUMENTS

| | | | | |
|---|---|---|---|---|
| 4,991,770 | A * | 2/1991 | Bird et al. | 700/42 |
| 5,052,187 | A * | 10/1991 | Robinson, Jr. | 62/238.6 |
| 5,568,377 | A | 10/1996 | Seem | |
| 5,735,134 | A | 4/1998 | Liu | |
| 6,253,113 | B1 | 6/2001 | Lu | |
| 6,264,111 | B1 | 7/2001 | Nicolson | |
| 6,467,288 | B2 * | 10/2002 | Kuroki et al. | 62/238.6 |
| 6,688,532 | B2 * | 2/2004 | Nanno et al. | 236/78 D |

* cited by examiner

*Primary Examiner*—Chen Wen Jiang
(74) *Attorney, Agent, or Firm*—Carlson, Gaskey, & Olds

(57) ABSTRACT

A PID control for a vapor compression system utilized to heat water identifies a particular range of error signals and derivative of the error signals that could be indicative of the cycle moving in an inefficient direction. If this determination is made, then a substitute for the error signal is utilized. In particular, the determination is made if both the error and the derivative of the error are negative. The substitute multiplies the error with its derivative to result in a positive product. This ensures the system will not move in the inefficient direction.

12 Claims, 1 Drawing Sheet

NON-LINEAR CONTROL ALGORITHM IN VAPOR COMPRESSION SYSTEMS

BACKGROUND OF THE INVENTION

This application relates to a non-linear PID control algorithm that avoids a potential adverse condition in a vapor compression system.

Refrigerant cycles provide temperature change in a fluid to be treated. In general, a refrigerant cycle includes a compressor for compressing a refrigerant, a first heat exchanger receiving the compressed refrigerant, an expansion device downstream of the first heat exchanger, and a second heat exchanger downstream of the expansion device. Refrigerant flows from the compressor, through the first heat exchanger, through the expansion device, through the second heat exchanger, and back to the compressor. A fluid is heated or cooled at one of the heat exchangers. This basic system can have many uses such as providing hot water, providing air conditioning or providing a heat pump function, among others.

One type of refrigerant cycle is a transcritical cycle. In a transcritical cycle, operation is above the saturation pressure. Thus, there is a degree of freedom with regard to the achieved pressure.

One particular application recently developed by the assignee of this application is for a hot water heating system, wherein the first heat exchanger receives water to be heated. A water pump delivers the water through the first heat exchanger.

As disclosed in co-pending U.S. patent application Ser. No. 10/793,489, filed on even date herewith and entitled "Pressure Regulation in a Transcritical HVAC System," a control may predict a desired discharge pressure to most efficiently achieve a hot water temperature. A control to achieve the efficient operation monitors a variable with regard to the hot water, and a variable with regard to the refrigerant discharge pressure. These variables are controlled in a manner disclosed in the U.S. patent application Ser. No. 10/793,542, filed on even date herewith and entitled "Multi-Variable Control of Refrigerant Systems."

The control determines error correction factors for both water temperature and refrigerant discharge pressure, by looking at an error between a desired and actual water temperature and discharge pressure, and both the derivative and integral of these errors.

The basic system 20 is illustrated in FIG. 1, wherein hot water is delivered from a line 21 to a downstream user 22. An input 24 allows an operator of the downstream use 22 to select a desired hot water temperature. It should be understood that the input might not be the selection of a particular temperature, but could instead be the position of a faucet handle, mixing valve handle, etc. Controls for translating these positions into a desired temperature are as known, and would be within the skill of a worker in this art. A sensor 26 senses actual hot water temperature leaving heat exchanger 28. A water pump 30 delivers water through the heat exchanger 28. Feedback from the sensor 26, the control 24, and to and from the water pump 30 are all delivered to an electronic control 32. A sensor 36 senses a discharge pressure downstream of a compressor 34 in a refrigerant cycle 35 associated with the water heating cycle. An expansion device 38 is positioned downstream of heat exchanger 28, and a second heat exchanger 40 is positioned downstream of expansion device 38. The expansion device 38 is controlled by the control 32, and has a variable opening such that the control 32 can open or close the expansion device 38 to control the pressure of the refrigerant within the cycle 35.

In a refrigerant system 35 operating in transcritical mode, there are two different steady state operational cycles available for a given set of ambient conditions. As one moves further to the right in the graph shown in FIG. 2, the operation becomes less efficient. Shown in FIG. 2 is a transition in time between the efficient (good) cycle and inefficient (bad) cycle when traditional control is implemented. The subject of this invention is alternative control that will avoid the transition between one discrete efficient cycle and the alternative inefficient cycle.

SUMMARY OF THE INVENTION

The present invention is directed to predicting and addressing when the control of the system would be moving to an inefficient mode. As will be shown below, an error correction algorithm for determining an error correction value looks at both the determined error and a derivative of that determined error. The control is modified under the teachings of this invention to utilize an alternative error calculation if both the error and its derivative are negative. In the disclosed embodiment, the control utilizes the error multiplied by the derivative of the error in the quadrant where the error and derivative of the error are negative. In all other quadrants, the error is not modified. This is illustrated in FIG. 3. Since these factors are both negative, the product would be a positive number, and the transition in time to the inefficient operation as shown in FIG. 2 is avoided.

These and other features of the present invention can be best understood from the following specification and drawings, the following of which is a brief description.

DETAILED DESCRIPTION OF THE PREFERRED EMBODIMENT

Figure 1:
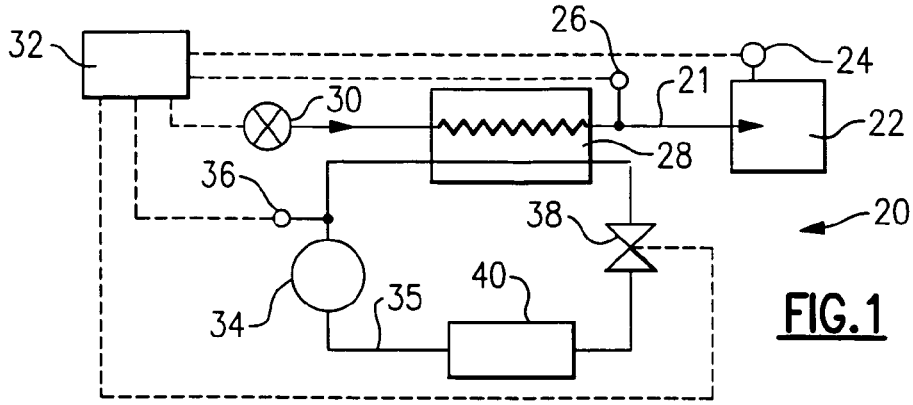
FIG. 1 is a schematic view of a system for providing hot water.

The system shown in FIG. 1 is operable to provide hot water at a desired temperature. The control 32 preferably monitors the actual temperature, and the actual pressure (36), and determines the error correction signal as disclosed in the above-mentioned co-pending U.S. Patent Application entitled "Multi-Variable Control of Refrigerant Systems." The error correction algorithms are listed below:

$$u_{EXV} = Kp_{11}e_p + Kp_{12}e_t + Ki_{11}\int e_p dt + Ki_{12}\int e_T dt + Kd_{11}\frac{de_p}{dt} + Kd_{12}\frac{de_T}{dt}$$

$$u_{VSP} = Kp_{21}e_p + Kp_{22}e_T + Ki_{21}\int e_p dt +$$

-continued $$Ki_{22}\int e_T dt + Kd_{21}\frac{de_p}{dt} + Kd_{22}\frac{de_T}{dt}$$

$U_{EXV}$ is an error correction factor for the expansion device, and $U_{VSP}$ is an error correction factor for the water pump. $e_p$ is the pressure error, i.e., the difference between actual and desired compressor discharge pressure. $e_T$ is the temperature error, i.e., the difference between actual and desired delivery water temperature. $K_{p11}$, $K_{p12}$, . . . etc., are numerical constants. The constants K are selected based upon the system, and also based upon the expected change that a particular change in water pump speed, for example, would have on the pressure. There are many methods for choosing the constants. The preferred method is the $H_\infty$ ("H infinity") design method, as explained for example in the textbook "Multivariable Feedback Design" by J. M. Maciejowski (Addison-Wesley, 1989). Note that according to these equations, $u_{EXV}$ and $u_{VSP}$ depend both on the current pressure and the current temperature.

In the present invention, there is preferably an adjustment to provide for correction and avoiding a particular condition wherein both the error for water temperature, and the derivative of the error are negative. This algorithm essentially utilizes an error that is the multiple of the detected error multiplied by the derivative of the detected error when both are negative. In this way, an otherwise potentially inefficient condition can be avoided.

Figure 2:
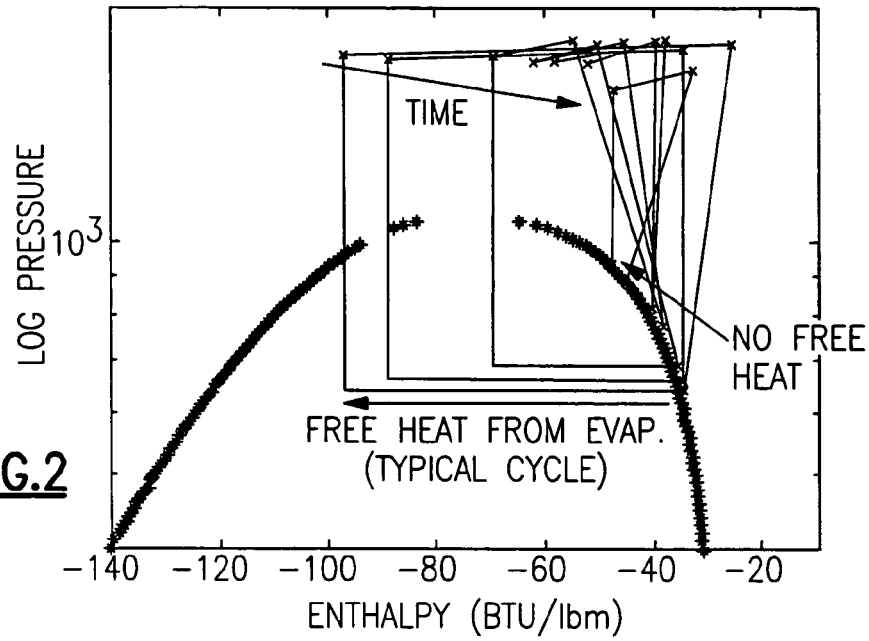
FIG. 2 is a pressure v. enthalpy chart.

The disclosed embodiment adjusts for water temperature error by changing the volume of water flow from pump 30 through heat exchanger 28. As this flow decreases, the temperature at 26 should increase. As can be appreciated from FIG. 3, however, if both the error for the water temperature, and the derivative of that error are negative, it is possible that further decreasing the water flow will no longer increase the temperature, but would instead decrease the leaving water temperature. The control, if not adjusted to address this concern, would continue to demand further decrease in the water flow until water flow is reduced to a minimum level. The heat pump will then not meet the customer demand, and it would also operate in the inefficient cycle shown in FIG. 2.

The present invention addresses this concern by utilizing a modified error factor for the $e_{vsp}$ number if both $e_{vsp}$ and the derivative of $e_{vsp}$ are negative. Thus, the following equation is incorporated into the control strategy:

$$\text{if } e_{vsp} < 0, \text{ and if } \frac{d(e_{vsp})}{dt} < 0$$

$$\text{then}(e_{vsp})_{used} = e_{vsp} * \frac{d(e_{vsp})}{dt}$$

$$\text{otherwise}(e_{vsp})_{used} = e_{vsp}$$

Figure 3:
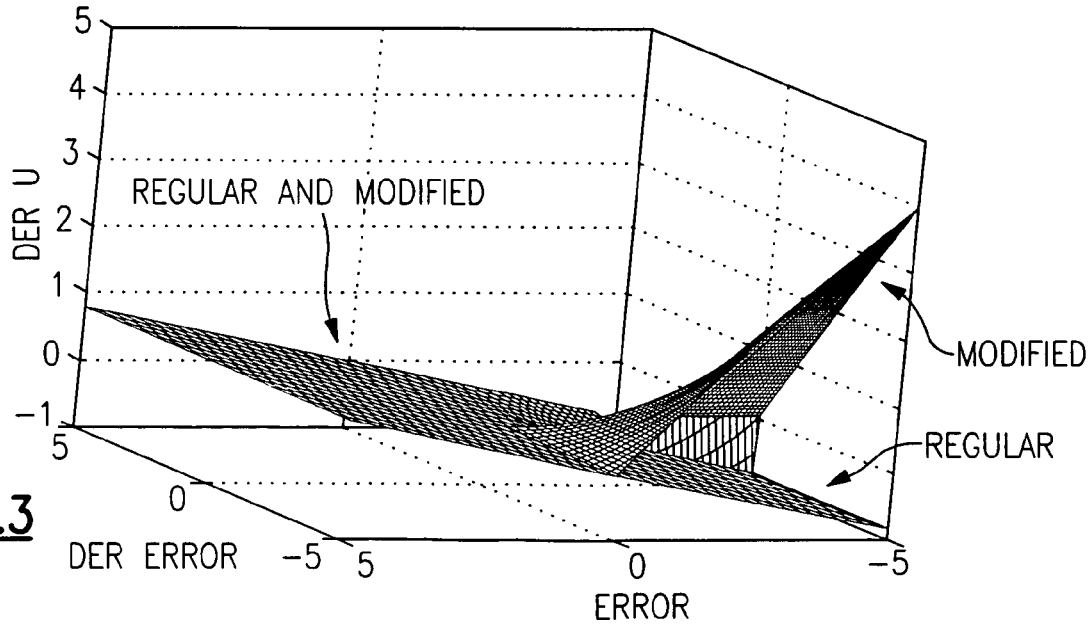
FIG. 3 shows the error calculation, both traditional and modified, depicting that in the quadrant where the error and derivative of error are negative, the actual error used by the controller is modified.

The alternative error provides the modified result as shown in FIG. 3. Thus, the present invention addresses a potential concern in the system as disclosed above.

While this invention is illustrated in a particular application of a vapor compression cycle, the invention provides benefits for other vapor compression cycles operating transcritically.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

a compressor;

a first heat exchanger downstream of said compressor;

an expansion device downstream of said first heat exchanger;

a second heat exchanger downstream of said expansion device;

a refrigerant passing from said compressor, to said first heat exchanger, to said expansion device, to said second heat exchanger, and then back to said compressor, said refrigerant operating in a transcritical mode within said refrigerant cycle; and a control having an error correction algorithm for controlling an aspect of said refrigerant cycle to move said aspect to approach a desired value, said error correction algorithm looking at both a determined error between an actual value and said desired value, and the derivative of said determined error, and said control algorithm substituting an alternative error value, should a condition of both the determined error, and the derivative of said determined error indicate said cycle is moving into an inefficient mode.

2. The refrigerant cycle as set forth in claim 1, wherein said condition is finding that both said determined error and said derivative of said determined error are negative.

3. The refrigerant cycle as set forth in claim 2, wherein said first heat exchanger receives a water to be heated by said refrigerant, and said aspect controlled by said error correction algorithm is the amount of water being delivered through said first heat exchanger to control an outlet temperature of said water.

4. The refrigerant cycle as set forth in claim 3, wherein said control further identifying a desired discharge pressure for the refrigerant, and said error correction algorithm for said amount of water also considering an error on said refrigerant pressure in determining an error correction factor for said amount of water.

5. The refrigerant cycle as set forth in claim 2, wherein said alternative error value is developed by multiplying said determined error by said derivative of said determined error to result in a positive alternative error value.

6. The system as set forth in claim 1, wherein said alternative error value being a multiple of the detected error multiplied by a factor including the derivative of the detected error.

7. A system comprising:

a refrigerant cycle including a compressor, a first heat exchanger downstream of said compressor, an expansion device downstream of said first heat exchanger, a second heat exchanger downstream of said expansion device, a refrigerant passing from said compressor, to said first heat exchanger, to said expansion device, to said second heat exchanger, and then back to said compressor, said refrigerant operating in a transcritical mode within said refrigerant cycle;

water to be heated being supplied to said first heat exchanger by a water pump, and an input to allow the selection of a desired hot water temperature; and a control for taking in an actual value of a hot water temperature downstream of said first heat exchanger, and comparing said actual water temperature to said desired water temperature to calculate a determined error, said control having an error correction algorithm controlling said water pump to change an amount of water delivered to said first heat exchanger, said error correction algorithm considering both said determined error, and a derivative of said determined error, and said control algorithm substituting an alternative error value, when both said determined error and a derivative of said determined error are negative, said alternative value being a positive value.

8. The system as set forth in claim 7, wherein error correction algorithm for said water temperature is:

$$u_{VSP} = Kp_{21}e_p + Kp_{22}e_T + Ki_{21}\int e_p dt + Ki_{22}\int e_T dt + Kd_{21}\frac{de_p}{dt} + Kd_{22}\frac{de_T}{dt}$$

wherein $u_{VSP}$ is an error correction for said water pump to change the amount of water, $e_t$ is the temperature error between actual and desired delivery water temperature, $e_p$ is an error between a desired and actual compressor discharge pressure, and the K values are numeric constants.

9. A method for operating a refrigerant cycle comprising the steps of:

(1) providing a refrigerant cycle including a compressor, a first heat exchanger downstream of said compressor, an expansion device downstream of said first heat exchanger, a second heat exchanger downstream of said expansion device, and a control for controlling said expansion device;

(2) circulating refrigerant from said compressor, to said first heat exchanger, to said expansion device, to said second heat exchanger and then back to said compressor, said refrigerant operating in a transcritical mode within said refrigerant cycle; and (3) monitoring an error in at least one value, and utilizing an error correction algorithm that considers both a monitored error and a derivative of said monitored error, and utilizing an alternative error value in said error correction algorithm should said monitored error and said derivative of said monitored error indicate that cycle is moving into an inefficient mode.

10. The method as set forth in claim 9, further including the steps of supplying a water to be heated to said first heat exchanger, and said determined error being the difference between a demanded water temperature and an actual water temperature.

11. The method as set forth in claim 9, wherein said alternative error value is utilized if both said monitored error and said derivative of said monitored error are negative.

12. The method as set forth in claim 9, wherein said alternative error value being a multiple of the detected error multiplied by a factor including the derivative of the detected error.

* * * * *